US005240021A

United States Patent [19]

Snodgrass

[11] Patent Number: 5,240,021

[45] Date of Patent: Aug. 31, 1993

[54] SUSPENSION TENT

[76] Inventor: Michael E. Snodgrass, 510 W. Union Bower, Irving, Tex. 75061

[21] Appl. No.: 767,489

[22] Filed: Sep. 30, 1991

[51] Int. Cl.[5] ..... E04D 13/08

[52] U.S. Cl. ..... 135/96; 135/116; 5/121; 5/128; 5/127; 5/113

[58] Field of Search ..... 5/121, 123, 128, 58, 5/414, 127, 129, 113, 308; 135/96, 116

[56] References Cited

U.S. PATENT DOCUMENTS

| | | | |
|---|---|---|---|
| 35,922 | 7/1862 | Chanelle | 5/121 |
| 46,195 | 1/1865 | Weber | 135/96 |
| 894,681 | 7/1908 | Miles | 135/116 |
| 968,017 | 8/1910 | Wilson | 5/121 |
| 1,395,158 | 10/1921 | Smith | 135/96 |
| 3,321,780 | 5/1967 | Morris | 5/123 |
| 3,848,279 | 11/1974 | Ipsen | 5/121 |
| 3,994,033 | 11/1976 | Bendell | 5/58 |
| 4,883,206 | 11/1989 | Miller | 135/96 |
| 4,945,584 | 8/1990 | La Mantia | 5/414 |

*Primary Examiner*—Henry E. Raduazo
*Attorney, Agent, or Firm*—Richard C. Litman

[57] ABSTRACT

A suspension tent having two basic components, a tent body and a frame. The tent body, which is of unitary construction, is comprised of two separate compartments, an upper bed compartment, enclosed by a canopy being of an umbrella arrangement, and a lower storage compartment. Both compartments are accessible from the outside of the tent through openings in the tent body. These openings can be close by a cloth closure, such as a flap, and a screen flap which may be fastened about the opening by some fastener, such as a zipper. The frame is constructed of a plurality of telescopic tubular sections. The tent body is suspended from the frame by fasteners located about the periphery of the bed compartment at each of the four corners. This suspension of the tent body permits the weight of the bed compartment to be distributed to the frame, providing adequate support for the user. The tent body is also pulled taut and fastened to the frame at each corner about the periphery of the bottom of the storage compartment. The suspension tent is easy to assembled, disassemble, and transport. It provides the user with a bed suspended above the earths terrain and a space for storage or where small children or pets may sleep.

14 Claims, 3 Drawing Sheets

SUSPENSION TENT

BACKGROUND OF THE INVENTION

1. Field of the invention

The present invention relates to a suspension tent having two basic components, a tent body and a frame structure. More particularly, the invention relates to a suspension tent having an upper bed compartment, which is suspended above the ground, and a lower storage compartment.

2. Description of the prior art

When traveling, specifically when camping, a temporary structure is often useful as a shelter from environmental conditions. The most common type of temporary shelter is a tent. Tents come in many sizes, shapes, and forms.

The dweller of a tent, typically, rests directly on the floor section which is adjacent to the ground. However, the ground could be cold, damp, or very rough. The condition of the ground could determine how comfortable the user may rest.

Some tents may provide just enough space or a single individual to sleep. Other tents may be large enough to accommodate more than one individual and provide some space for storage. However, the larger the tent, the harder it may be to erect or take down and transport.

Assembly and disassembly of tents is more complex for some tents than for others. Some may require little assembly and as a result the tent body may be too small or the tent frame may be too bulky. A bulky tent may not be practical to transport. Some may require a great deal of assembly, hence, may be cumbersome and time consuming to assembly.

A particular type of tent erected on a hammock is described in U.S. Pat. No. 4,862,906 to JORDON (issued Sep. 5, 1989). This patent discloses a tent-hammock combination in which five alternative structures may be formed. One of these alternative structures is a hanging pup tent secured to a pair of trees with a hammock serving as the floor. The availability of suitable trees may place some limitations on its functionality.

U.S. Pat. No. 4,686,720 to NEWELL (issued Aug. 18, 1987) is similar to the JORDON tent-hammock described above. This patent discloses a covered hammock which is also hung between two trees, again limiting its portability to the environment where it may be used. Moreover, the covered hammock may only be practical for one man, not allowing additional space, such as for storage. This covered hammock, however, does have upper and lower fabric panels which are integrally sewn together to form a one piece construction.

A bed tent in which a canopy has a base adapted to fit snugly around the periphery of a conventional mattress is disclosed in U.S. Pat. No. 4,590,956 to GRIESENBECK (issued May 27, 1986). This canopy is adapted to be supported above the mattress by a frame work comprising diagonally disposed flexible frame members. Though the tent is of a one piece construction, its coexistence with a mattress may render it of little use by itself.

A tent having a hammock suspended within an enclosure is described in U.S. Pat. No. 425,540 to FORBRIGER (issued Apr. 15, 1890). This patent discloses a tent having a metal frame of unitary construction, having a hammock suspended within the frame, and a canopy draped over the outside of the frame covering the frame and the hammock within. Since the frame does not require any assembly or disassembly, it may be bulky and inconvenient to transport. Moreover, the frame is constructed to be free moving, as is the hammock. This may not provide the stability desired by the user. The canopy provides a roof panel and four wall panels, but no floor panel. Because this canopy is does not have a floor panel attached, it may not provide optimum protection desired from the environment.

It is therefore an object of the present invention to provide a portable tent with a bed compartment attached within the tent and suspended above the ground.

Another object of the present invention is to provide a portable tent which utilizes space efficiently enough to provide a storage area where the user can store items inside away from the wildlife and safe from theft.

It is further an object of the present invention to provide a portable tent which can be easily assembled, easily disassembled, and easily transported.

It is among additional objectives of the present invention to provide a tent that has a tent body which is of one piece construction, having a streamlined structure to resist wind and rainfall, and having a reinforced floor panel to endure moisture and rough terrain.

SUMMARY OF THE INVENTION

The above and other objects are accomplished in accordance with the present invention, a suspension tent having two basic components, a tent body and a frame. The tent body has two compartments, an upper bed compartment and a lower storage compartment. The suspension tent is portable, it can easily be assembled or disassembled, and is easily transported.

The tent body is of unitary construction having the bed compartment suspended above the ground. The bed compartment is enclosed by a streamlined canopy which resists the effects of wind and rain. The storage compartment is located below the bed compartment. Both compartments may be accessible to one another from within the tent. Both compartments are also accessible from the exterior through openings that can be concealed by cloth flaps which may be zipped closed. Removable screen flaps may be placed to the inside of the cloth flaps to provide ventilation when the cloth flaps are open.

The foregoing and other features, advantages and other objects of the invention may be more fully appreciated by the reference to the following detailed description and drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
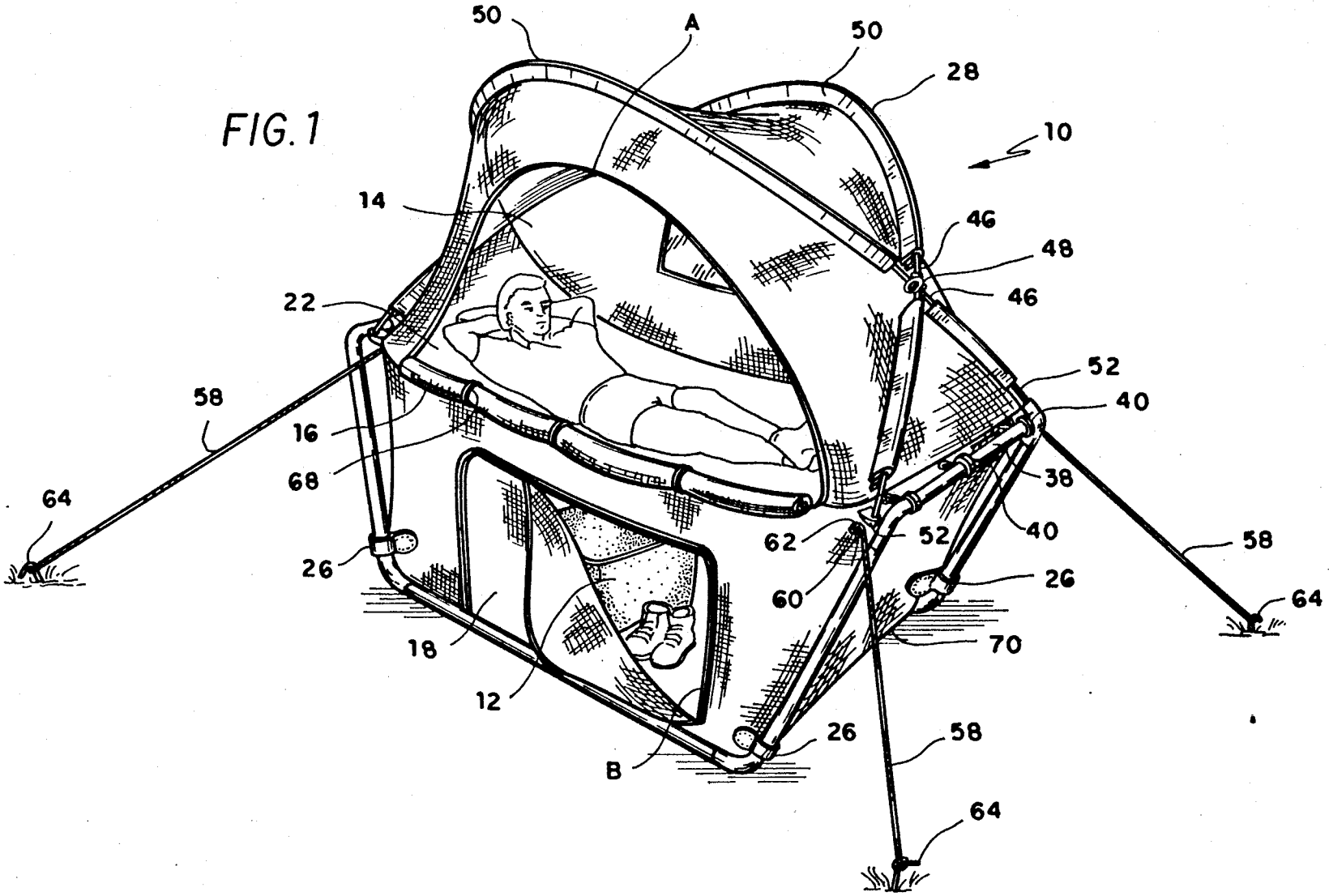
FIG. 1 is an environmental perspective view of the tent showing a one occupant embodiment of the present invention.
Figure 2:
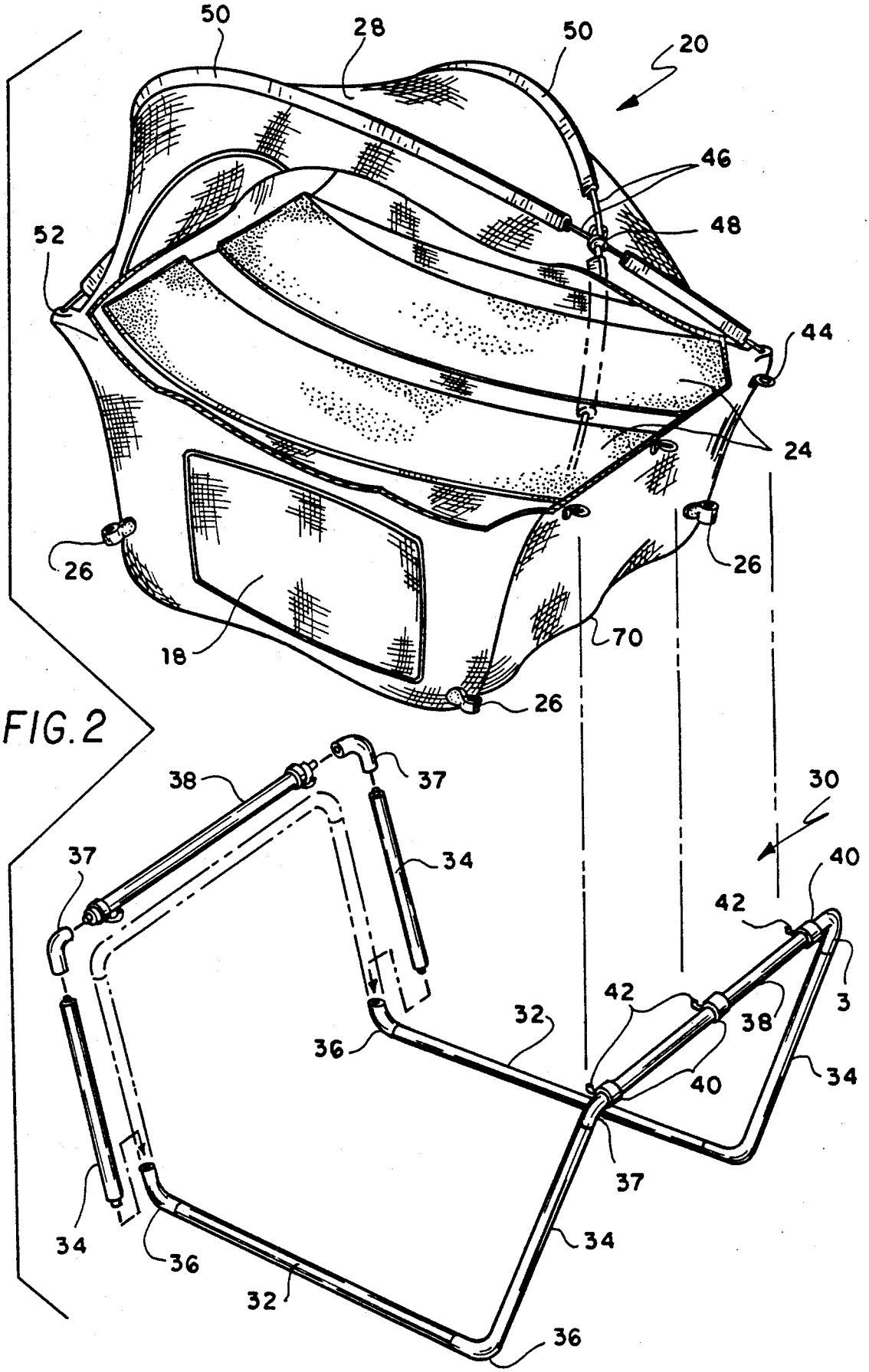
FIG. 2 is a cutaway view of the tent body showing a two occupant embodiment and a partially exploded view of the tubular frame structure of the present invention.

Referring to the drawing, particularly FIG. 1 and FIG. 2, the suspension tent 10 is comprised of a tent body 20, being of one piece construction, suspended from a frame 30, having a plurality of interengaging tubular members.

The frame 30 is comprised of a combination of parallel lateral base sections 32 connected at each end to divergent upright sections 34 by angular corner sections 36. The divergent upright sections 34 are in turn connected to cross members 38 by corner sections 36.

The tent body 20 is preferably of unitary construction, being of a light weight, durable, and water resistant fabric. This tent body 20 is comprised of two compartments, a storage compartment 12, and a bed compartment 14. This storage compartment 12 can offer protection for personal items from wildlife or theft, or it may be utilized as a place where small children or pets may sleep.

Figure 3:
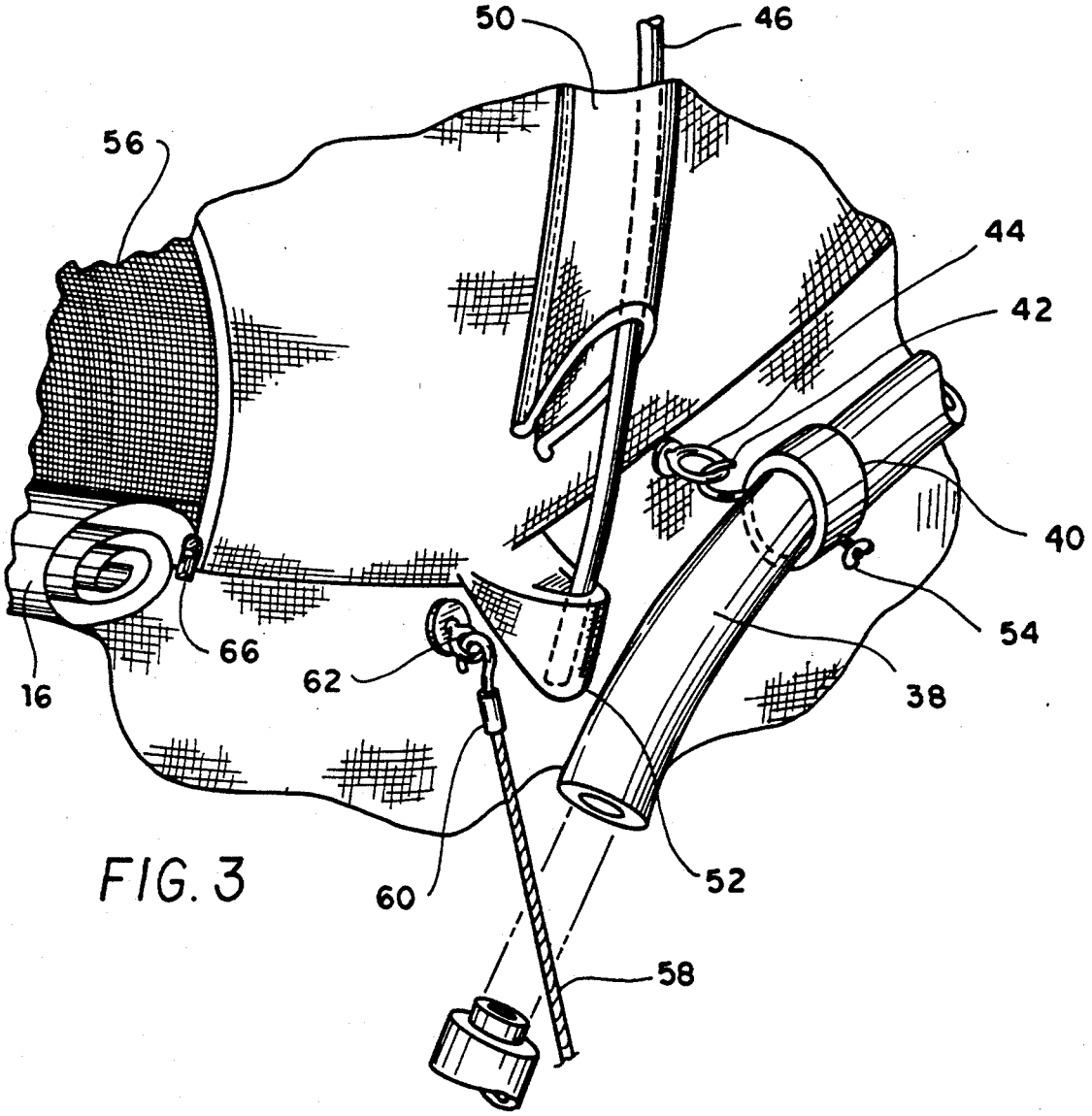
FIG. 3 is a detailed view showing how the tent body is coupled to various elements of the present invention.

Both the bed compartment 14 and the storage compartment 12 may be accessed externally from one or both sides of the tent body 20. The bed compartment 14 may be accessible through a substantially semi-circular opening A having a cloth closure 16, such as a flap. The storage compartment 12 may be accessible externally from one or both sides of the tent body 20 through a substantially rectangular opening B having a primary closure means 18, such as a flap. A secondary closure means, such as a screen 56, as shown in FIG. 3, may be placed on the inside of each opening to provide ventilation when the cloth closures 16 and 18 are in an open position. The cloth closures 16 and 18 may be opened and closed by any suitable fastening means, such as a zipper 66 as shown in FIG. 3. The screen 56 would also have a similar secondary fastening means (not shown). The cloth closures 16 and 18 can be rolled into a very small compass and fastened by straps 68 to the exterior of the tent body 20.

Referring to the one occupant alternative of FIG. 1, it is preferable that the bed panel 22 be stitched about it entire periphery of the inside of the tent body 20.

Referring to the two occupant alternative of FIG. 2, the two separate coplanar horizontal bed panels 24 are placed side by side spaced a distance apart to provide access to the storage compartment 12. It is preferable that these panels 24 be stitched only at the head and the foot of the interior of the tent body 20.

The bed panel(s) 22 and 24 are fastened to the interior of tent body 20 adjacent to where the tent body 20 is secured to the cross members 38. This is so the stress from the weight on the bed panel(s) 22 and 24 are distributed to the cross members 38.

Referring to FIG. 1, FIG. 2, and FIG. 3, the tent body 20 is suspended from the frame 30 by means of a hook 42 located on a slip ring 40, which is attached to the cross members 38 of the frame 30, and an eye hook 44, which is secured to tent body 20. The tent body 20 is secured about the four corners of lower periphery of the storage compartment 12 by a support sleeve 26 stitched to the tent body 20 and held taut by the corner sections 36 and the lower portion of the divergent upright sections 34. The floor panel 70 of the storage area 12 is preferably constructed of a reinforced fabric having sufficient strength to endure wet marshy areas and rough terrain.

The canopy 28, being of an umbrella arrangement, is suspended above the bed compartment 14 by two flexible rods laterally spaced apart, crisscrossed and coupled by a rope 48 at the intersection. These telescopic bows 46 are slipped through hems 50 which are stitched to the top of the canopy 28. The telescopic bows 46 are anchored at the four corners about the periphery of the bed compartment in the anchor sleeves 52 fastened to the outside of the tent body 20. These anchor sleeves 52 are located proximate the boundary between the bed compartment 14 and the storage compartment 12.

Referring to FIG. 2 and FIG. 3, the assembly of the suspension tent 10 is as follows. The two parallel lateral sections 32 are spaced apart parallel to one another at a distance equal to approximately the length of cross member 38. The corner sections 36 are attached to both ends of each of the parallel lateral sections 32. The tent body 20 is then unfolded and spread between the lateral sections 32 slipping the corner sections 36 into the support sleeves 26 located near the bottom periphery of the storage compartment 12. This pulls the floor panel 70 taut. The divergent upright sections 34 are inserted into the corner sections 36 which are attached to the parallel lateral sections 32. The upper corner sections 37 are inserted on top of the divergent upright sections 34. The three slip rings 40 are slid along each cross member 38, where cross members 38 are connected at each end to the upper corner sections 37 which are attached to the top of the divergent upright members 34.

Now, with the frame 30 complete, the tent body 20 can be suspended by the hooks 42 located on the slip rings 40 by engaging the eye hooks 44 located on the tent body 20. The slip rings 40 may now be tightened to the cross members 38 by the thumb screws 54, the thumb screws 54 being preferably present, though not shown in FIG. 2, on all the slip rings 40.

The canopy 28 is erected by inserting the flexible rods 46 through the lateral hems 50. The bottoms of the telescopic rods 46 are anchored diagonally into the anchor sleeves 52 stitched on the tent body 20 opposite the hem 50. At the point where the two flexible rods 46 meet, shown in FIGS. 1 and 2, they are engaged with one another by a fastening means a fastening means, such as a rope 48.

The suspension tent 10 may be stabilized by means of a guy rope 58 extending from each corner of the tent body 20 to a ground stake 64. One end of each of the guy ropes 58 has a hook 60 attached. This hook 60 is secured to an eye hook 62 located near the bed compartment 14 on the outside of the tent body 20 at each of the four corners. The other end of the guy rope 58 is secured to the ground by tying it to a tent pin 64. This secures the suspension tent 10 to the ground offering greater resistance to wind and rain. The assembled suspension tent 10 is now ready for use. The suspension tent 10 can be moved short distances while assembled simply by detaching the guy ropes 58.

The suspension tent 10 may be disassembled as simply as it was assembled. The tent body 20 can be rolled into a very tight compass and it, along with the disassembled frame sections, can be stored or easily transported in a tote bag.

It is to be understood that the present invention is not limited to the sole embodiment described above, but encompasses any and all embodiments within the scope of the following claims.

I claim:

1. A suspension tent which is comprised of:

a resilient frame including a plurality of tubular sections, a tent body of unitary construction supported on said frame and including an upper bed compartment enclosed by a canopy and a lower storage compartment, an access means for each of said compartments, a fastening means for fastening said tent to said frame, said upper bed compartment includes a lower boundary comprising a horizontal bed panel enclosed by said canopy, and said upper bed compartment being formed in a unitary fashion with said canopy and said lower storage compartment.

2. The suspension tent as defined in claim 1, whereby said frame includes interengaging members assembled to form two parallel u-shaped sections respectively joined together at each end by cross members.

3. The suspension tent as defined in claim 1, including a plurality of flexible rods laterally spaced apart, said canopy engaged with and supported by said flexible rods.

4. The suspension tent as defined in claim 1, whereby said lower storage compartment includes a bottom panel and a plurality of walls joined to said bottom panel.

5. The suspension tent as defined in claim 1, whereby said access means comprises an opening for entering and exiting each of said compartments.

6. The suspension tent as defined in claim 1, including a disengageable fastening means secured to said cross-members of said frame to suspend said tent body.

7. The suspension tent as defined in claim 3, whereby said bed compartment includes a lower boundary comprising a plurality of horizontal bed panels.

8. The suspension tent as defined in claim 3, whereby said canopy includes means to define a receiving area and said flexible rods are insertable in said receiving area, thus supporting said canopy.

9. The suspension tent as defined in claim 3, whereby said rods are a pair, said rods intersecting on a diagonal.

10. The suspension tent as defined in claim 4, including a fastening means operable to secure said bottom panel to said frame.

11. The suspension tent as defined in claim 5, including a primary closure means, having a fastening means to open and close each of said openings.

12. The suspension tent as defined in claim 5, including a secondary closure means, to allow for ventilation, having a secondary fastening means to open and close each of said openings.

13. The suspension tent as defined in claim 7, whereby the said bed panels are joined to the inside of said tent body.

14. The suspension tent as defined in claim 8, wherein said means to define a receiving area is a plurality of hems.

* * * * *